United States Patent [19]

Kapolnek et al.

[11] Patent Number: 4,771,860

[45] Date of Patent: Sep. 20, 1988

[54] EDGE SEALING MEANS IN A SOUND-ABSORBING COVER FOR USE IN A SOUND-EMITTING BODY

[75] Inventors: Peter Kapolnek, Stuttgart; Mirko Tikvicki, Nuremberg, both of Fed. Rep. of Germany

[73] Assignee: Siemens Aktiengesellschaft, Berlin and Munich, Fed. Rep. of Germany

[21] Appl. No.: 82,827

[22] Filed: Aug. 6, 1987

[30] Foreign Application Priority Data

Dec. 10, 1986 [DE] Fed. Rep. of Germany ..... 3626648

[51] Int. Cl.[4] ..... E04B 1/82

[52] U.S. Cl. ..... 181/290; 181/208; 181/284; 181/288

[58] Field of Search ..... 181/207, 208, 284, 288, 181/290

[56] References Cited

U.S. PATENT DOCUMENTS 4,362,222 12/1982 Hellstrom ..... 181/295 X
4,463,049 7/1984 Kracke ..... 181/290 X

FOREIGN PATENT DOCUMENTS 1110388 7/1961 Fed. Rep. of Germany .
1534727 9/1966 Fed. Rep. of Germany .
1227142 10/1966 Fed. Rep. of Germany .

*Primary Examiner*—B. R. Fuller
*Attorney, Agent, or Firm*—Kenyon & Kenyon

[57] ABSTRACT

Adjustable packing strips (3, 4) are held on the inside of a carrying sheet (6) covered with sound-absorbing material (5), and are slidable by adjustment elements (7, 9), which can be actuated and fastened from the outside, within an adjustment chamber isolated against the sounds of a sound-emitting body (2) to project the packing strips beyond the peripheral edge (6A) of the carrying sheet (6).

5 Claims, 1 Drawing Sheet

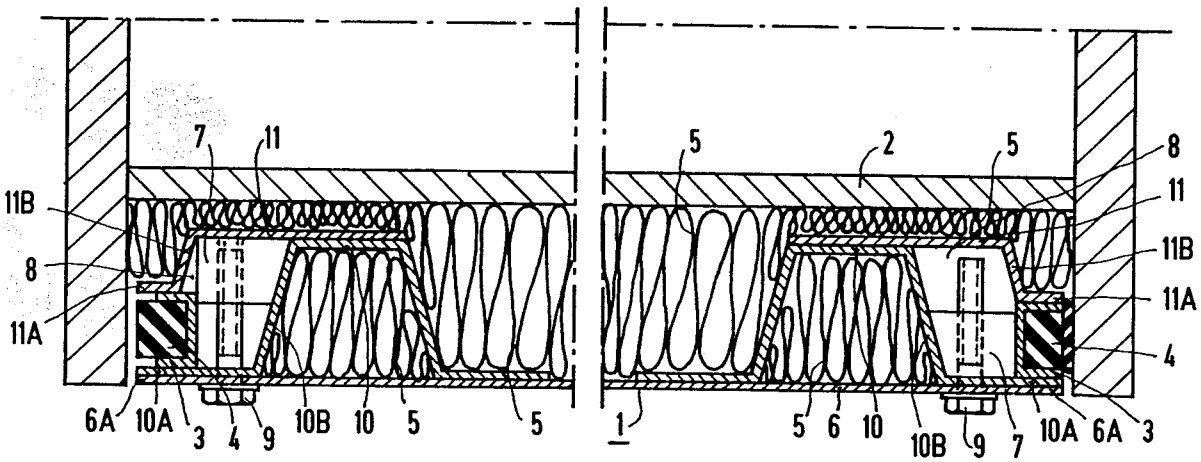
8
11
11B
11A
4
3
6A
10A
7
9
10B
10
6
5
2
1
11B
8
11A
6A
10A
3
4
9
10B
10
5
7
11

EDGE SEALING MEANS IN A SOUND-ABSORBING COVER FOR USE IN A SOUND-EMITTING BODY

BACKGROUND AND SUMMARY OF THE INVENTION

The invention relates to an edge sealing means in a sound-absorbing cover for use in a sound-emitting body.

When using packing strips of the type which are to be screwed down onto a sound-emitting body, excessive tightening of the bolts during assembly can result in body sounds reaching into the sound-absorbing cover and from there to the outside. This may occur in spite of the use of an elastic covering.

The primary objective of the present invention is to provide an edge sealing means in a sound-absorbing cover of the above described type, in which sound bridges from the equipment through the covering and to the outside are avoided in a simple manner. The cover of the invention achieves its objective while being securely mounted to the sound emitting body yet readily detachable when desired. Generally, the invention comprises an edge sealing means in a sound-absorbing cover of a sound-emitting body. Elastic sealing materials in the form of strips are arranged for outward expansion about the outer phiphery of a carrying sheet which is covered on the inside with a sound absorbing material. Cooperating adjustment elements are fastened within a sound insulated, adjustment chamber and are actuatable from the outside of the sound-absorbing cover after mounting upon the sound-emitting body to expand the packing strips beyond the phipheral edge of the carrying sheet and into engagement with the sound-emitting body to secure the cover upon the body.

For a better understanding of the above and other features and advantages of the invention reference should be made to the following detailed description of a preferred embodiment of the invention and to the accompanying drawing.

BRIEF DESCRIPTION OF THE DRAWING

The drawing illustrates a cross section of a parallel covering arranged between planar parts of a sound emitting body in accordance with the invention.

DETAILED DESCRIPTION OF A PREFERRED EMBODIMENT OF THE INVENTION

In a recess of a sound-emitting body 2 bounded by planar walls arranged in a rectangle, a sound-absorbing cover 1 is located, the contours of which are adapted to conform to the contours of the recess with a relatively small continuous edge interspace provided for the ready insertion of the cover 1.

The cover 1 consists of a planar rigid carrying sheet 6 with peripheral edges 6A. The carrying sheet 6 is covered on its inside with sound absorbing material 5. In the opposing edge regions perpendicular to the plane of drawing is an abutment 10 with a sliding plane 10B oblique with respect to the carrying sheet plane and a bearing surface 10A fastened at the inside of the carrying sheet, forming an angle with the sliding plane 10B and extending to the edge 6A. The abutment 10 braces itself as an open hollow profile on the other side of the inclined sliding plane 10B against the carrying sheet 6 and is equipped at the upper end of the oblique sliding surface 10B with a boundary wall 11 to define an adjustment chamber 8. The adjustment chamber 8 is built toward the edge 6A and includes a guide surface 11A parallel to the carrying sheet for a packing strip 3, 4. The packing strip consists of a rigid strip 3 open toward the edge 6A with U-shaped section. Mounted within the strip 3 is an elastic resiliant sealing material 4 which is arranged to project beyond the side of the strip 3.

As defined by the boundary wall 11 and the abutment 10, the adjustment chamber 8 is free of the sound absorbing material 5, and houses a wedge-shaped adjustment element 7. The adjustment element 7 is arranged with an oblique face against the inclined plane 10B and with its opposing face directed perpendicular to the plane of the carrying sheet 6 and against the back of the packing strip 3. Through an opening in the carrying sheet 6, a tension bolt 9 is screwed into the adjustment element 7. Upon being screwed into the adjustment chamber 8, the tension bolt 9 displaces the threadedly engaged adjustment element 7 along the slide surface 10B towards the edge 6A and in the process causes the packing strip 3, 4 to be displaced beyond the edge 6A and into engagement with the side walls of the body 2. Due to elastic deformation of the resilient material 4—an edge sound-absorbing clamping connection which holds the cover 1 securely is ensured, which can again be released when the tension bolts 9 are unscrewed.

The above description of a preferred embodiment of the invention is meant to be representative only as certain changes may be made therein by those skilled in the art without departing from the clear teachings of the invention. Accordingly, reference should be made to the following appended claims in determing the full scope of the invention.

What is claimed is:

1. An edge sealing means in a sound-absorbing cover for use in a sound emitting body, which comprises (a) a carrying sheet mounted upon said sound-emitting body;

(b) sound-absorbing material disposed between said sound-emitting body and said carrying sheet;

(c) elastic sealing material packing strip means mounted upon a periphery of said carrying sheet and selectively extendible beyond the periphery of said carrying sheet into engagement with said sound-emitting body;

(d) at least one sound insulated, adjustment chamber structure defined by said carrying sheet adjacent to the periphery of the carrying sheet;

(e) at least one adjustment element mounted within said at least one sound insulated, adjustment chamber; and (f) said adjustment element including at least one actuator element at least partially disposed externally of said carrying sheet and said sound-emitting body for actuation of said adjustment element to selectively move said elastic sealing material packing strip means beyond the periphery of said carrying sheet and into said engagement with said sound emitting body to secure said sound-absorbing cover.

2. The edge sealing means according to claim 1, further characterized by (a) said at least one adjustment element including a wedge-shaped block selectively adjustable along a slide surface (10B) disposed within said adjustment chamber and against the packing strip means;

(b) said slide surface being oblique with respect to the carrying sheet (6), and (c) a parallel guide surface (11A) of a boundary wall (11) of the adjustment chamber (8) to co-operate with said carrying sheet to guide said packing strip means beyond said periphery upon adjustment of said wedge-shaped block against the packing strip means.

3. The edge sealing means according to either claims 1 or 2, further characterized by an abutment having a cross section with at least one bearing surface (10A) forming an angle with the slide surface (10B).

4. The edge sealing means according to claim 3, further characterized by said packing strip means being mounted in a U-shaped section member, the legs of which are in engagement with the bearing and guide surfaces (10A, 11A) and the connecting strap is in engagement with a side of said wedge-shaped block.

5. The edge sealing means according to either of claims 1 or 2, further characterized by said at least one actuator comprising at least one tension bolt (9) arranged at least partially externally of said carrying sheet and said sound-emitting body and being longitudinally slidable relative to the carrying sheet to adjust said adjustment element to move said packing strip means beyond said periphery and into said engagement with said sound-emitting body.

* * * * *